United States Patent [19]

Pelzl et al.

[11] Patent Number: 4,772,227

[45] Date of Patent: Sep. 20, 1988

[54] ELECTRIC PLUG CONNECTION WITH A CODER DEVICE

[75] Inventors: Leo Pelzl, Holzkirchen; Peter Seidel, Groebenzell; Karl Zell, Niederpoecking, all of Fed. Rep. of Germany

[73] Assignee: Siemens Aktiengesellschaft, Berlin & Munich, Fed. Rep. of Germany

[21] Appl. No.: 780,696

[22] Filed: Sep. 26, 1985

[30] Foreign Application Priority Data

Sep. 27, 1984 [DE] Fed. Rep. of Germany ..... 3435505

[51] Int. Cl.[4] ..... H01R 13/645

[52] U.S. Cl. ..... 439/681

[58] Field of Search ..... 339/186 M, 186 R; 439/680, 681

[56] References Cited

U.S. PATENT DOCUMENTS

| | | | |
|---|---|---|---|
| 3,287,031 | 11/1966 | Simmons et al. | 339/186 R |
| 4,448,467 | 5/1984 | Weidler | 339/186 M |
| 4,478,469 | 10/1984 | Waite et al. | 339/186 M |

FOREIGN PATENT DOCUMENTS

| | | | |
|---|---|---|---|
| 0036770 | 9/1981 | European Pat. Off. | 339/186 R |
| 1640872 | 10/1970 | Fed. Rep. of Germany | 339/186 M |
| 2021547 | 11/1971 | Fed. Rep. of Germany | 339/186 M |
| 2455409 | 8/1976 | Fed. Rep. of Germany | 339/186 M |
| 2743033 | 3/1979 | Fed. Rep. of Germany | 339/186 M |
| 1604092 | 12/1981 | United Kingdom | 339/186 M |

*Primary Examiner*—J. Patrick McQuade

*Attorney, Agent, or Firm*—Hill, Van Santen, Steadman & Simpson

[57] ABSTRACT

The coder device prevents plugs being assembled to a counter-plug device having a different coding. The coder device is formed by tongue-like projections on a plug and by corresponding chamber-like recesses on the counter-plug device. The projections are provided with a theoretical breakage point and can be broken off. The broken off projections can be inserted into the associated recess of the housing of the counter-plug device. By breaking off projections in different combinations, it is possible to individualize the original universal coder device.

7 Claims, 2 Drawing Sheets

6
1
3
4
4
5
2

ELECTRIC PLUG CONNECTION WITH A CODER DEVICE

BACKGROUND OF THE INVENTION

1. Field of the Invention

The invention relates to a multi-pole plug connection with a coder device for coding a plug and a counter-plug.

2. Description of the Prior Art

It is known to provide for example that the plug strips of insertable assemblies be screwed to coder strips which are provided with projections pointing in the plug-in direction. The associated counter-plug device is screwed to a counter-coder strip which is provided with recesses which match the projections. The shape or arrangement of the projections and recesses differs for different assemblies. In this way it is ensured that the assemblies are inserted into the assembly frames at the correct locations. The various coder strips and counter-coder strips must be kept available in appropriate numbers of types designed for example as injection molded components.

In the assembly of the aforementioned coder strips and counter-coder strips it must also be ensured that no mix-ups occur.

SUMMARY OF THE INVENTION

The aim of the invention is to reduce the cost for the coding and to increase the reliability of the coding.

This aim is realized by the invention in that the plug and the counter plug-in are reciprocally provided with projections, pointing in the plug direction, and corresponding recesses into which the projections engage in the assembled state, wherein the projections can be broken off at a breakage point and can be inserted into the associated recess. As a result of the breaking-off and insertion of the projections into the associated recess, the various plugs and counter-plug devices are selectively provided with different coder patterns without the need to keep available different types of coder strips for this purpose. This is of particular advantage for assembly at the location of the user. The breaking off and insertion of the projections into the associated recesses can take place directly prior to the insertion of the assembly into the assembly frame. Should a projection be mistakenly inserted into the incorrect recess, then this mistake will be identified immediately thereafter during assembly since the two plug parts will not mate.

In accordance with a further development of the invention, the projections are injection-molded in the form of tongues onto one of the connector housings and the chamber-like recesses form an integral part of the housing of the counter-plug device. This avoids the need for separate coder strips so that it is also unnecessary to screw such coder strips to the connector housings.

In accordance with another further development of the invention the broken-off projections are clamped or locked in the recesses. This prevents the inserted projections from being able to fall out, for example during transportation. The theoretical breakage point on the projection can expediently be provided as a constriction at the base of the tongue-like projections.

BRIEF DESCRIPTION OF THE DRAWINGS

In the following the invention will be explained in detail in the form of an exemplary embodiment which is illustrated in the drawing.

DESCRIPTION OF THE PREFERRED EMBODIMENTS

Figure 1:
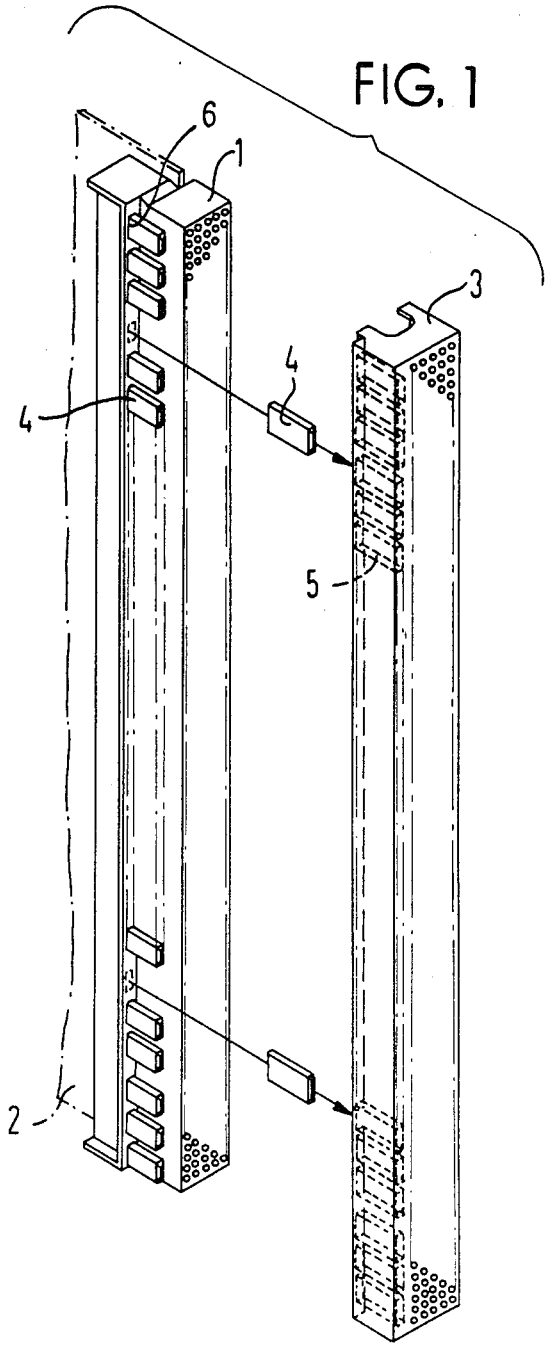
FIG. 1 schematically represents a perspective view of a plug of an insertable electric assembly with a circuit board shown in a dash-dotted line and a housing of a counter-plug device.
Figure 2:
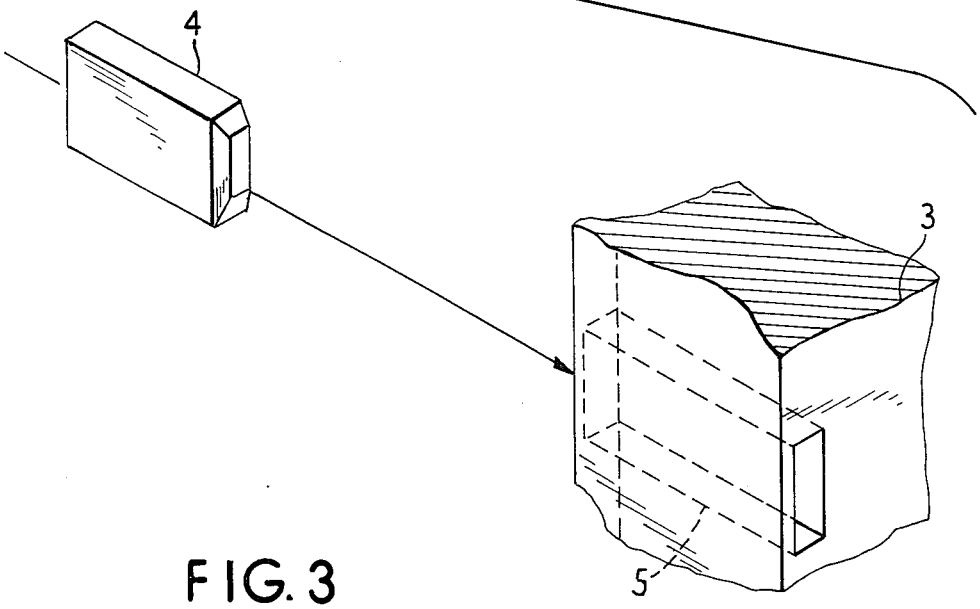
FIG. 2 is a schematic perspective view of a plug embodying a clamping arrangement between a projection and a recess.
Figure 3:
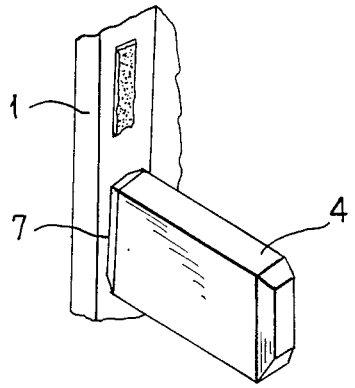
FIG. 3 is a schematic perspective view of a projection incorporating a grooved attachment to the plug body.

The synthetic body of a plug 1 is provided with tonguelike projections 4 which point in the direction of a housing 3 of a counter-plug device and which are arranged along the longitudinal side of the plug 1. A counter-plug device of this kind can consist for example of contact pins which are impressed into a rear wall wiring board of the assembly frame. The housing 3 is then passed over these contact pins so that the pins project into the interior of the housing 3. The housing 3 of the counter-plug device is provided with matching, chamber-like recesses 5 into which the projections 4 engage in the assembled state. At their point of attachment 6 to the synthetic body, the projections 4 are grooved as at 7, FIG. 3, thus forming a theoretical breakage point which allows the projections 4 to be easily broken off. As represented by the arrows, the broken off projections 4 are inserted into the associated recess 5 of the housing 3 of the counter-plug device where they may be clamped or locked as illustrated in FIG. 2 to prevent the projections from becoming dislodged. The projections 4 can be broken off and inserted into the associated recesses 5 in any desired number and distribution. This ensures that a plug, for example plug 3, which has an intact or captured projection which has been broken off from another plug, for example plug 1, at the same point cannot be confused with the other plug, that is, plug 1.

This ensures that a plug which has an intact projection at a given point cannot be confused with another plug which has had the projection at the corresponding point removed.

As is apparent from the foregoing specification, the invention is susceptible of being embodied with various alterations and modifications which may differ particularly from those that have been described in the preceeding specification and description. It should be understood that we wish to embody within the scope of the patent warrented hereon all such modifications as reasonably and properly come within the scope of our contribution to the art.

We claim as our invention:

1. A multi-pole electric plug connection with a coder device, comprising a plug and an associated counter-plug device pluggable together in a plug-in direction to form the plug connection, said plug being provided with integrally formed projections, pointing in the plug-in direction, and said counter-plug being provided with corresponding recesses into which the projections frictionally engage in the assembled state, wherein selected projections can be broken off at a theoretical breakage point from the plug and can be inserted into and held in the associated corresponding recess in the counter-plug to provide a specifically coded plug.

2. A plug connection as claimed in claim 1, wherein the projections are injection molded, in the form of tongues, to said plug and are provided with a groove-type breakage constriction.

3. A plug connection as claimed in claim 1, wherein the recesses represent chambers in the counter-plug device.

4. A plug connection as claimed in claim 1, wherein the broken-off projections are clamped in the recesses.

5. A multi-pole electric plug connection with a coder device, comprising:

a plug having a housing with a plurality of integrally formed projections extending in a plug direction;

a counter-plug having a housing with a plurality of recesses which are frictionally matable with said plug projections;

said projections being individually removable from said plug housing and insertable into said recesses in said counter-plug housing to be frictionally held therein;

whereby, said plug can be specifically coded to said counter plug.

6. A plug connection according to claim 5, wherein said projections are provided with a detachment means to facilitate manual removal of said projections from said plug housing.

7. A plug connection according to claim 5, wherein the removed projections are clamped in said counter plug recesses.

* * * * *